United States Patent [19]

Laux et al.

[11] Patent Number: 4,506,894

[45] Date of Patent: Mar. 26, 1985

[54] AERIAL TOY

[75] Inventors: Keith R. Laux, Columbus; William F. Getgey, Cincinnati, both of Ohio

[73] Assignee: Idea Development Company, Inc., Cincinnati, Ohio

[21] Appl. No.: 519,918

[22] Filed: Aug. 3, 1983

[51] Int. Cl.[3] ..... A63B 65/08

[52] U.S. Cl. ..... 273/425; 273/426

[58] Field of Search ..... 273/425, 426

[56] References Cited

U.S. PATENT DOCUMENTS

| | | | |
|---|---|---|---|
| 692,608 | 2/1902 | Bristow | 273/426 |
| 2,816,764 | 12/1957 | Gleason | 273/426 |
| 3,082,572 | 3/1963 | Knox, Jr. | 273/426 X |
| 3,403,910 | 10/1968 | Claycomb | 273/426 |
| 3,765,122 | 10/1973 | English | 273/425 X |
| 3,814,431 | 6/1974 | Callahan | 273/426 |
| 3,955,817 | 5/1976 | Davis | 273/426 X |
| 4,337,950 | 7/1982 | Gidge | 273/426 |
| 4,421,320 | 12/1983 | Robson | 273/425 |

FOREIGN PATENT DOCUMENTS

| | | | |
|---|---|---|---|
| 289489 | 8/1964 | Australia | 273/426 |
| 718215 | 11/1954 | United Kingdom | 273/426 |

*Primary Examiner*—Paul E. Shapiro

*Attorney, Agent, or Firm*—Wood, Herron & Evans

[57] ABSTRACT

An aerial toy is disclosed which can be launched to sail outwardly away from the point of launching and subsequently reverse its flight and return to the point of launching, and which can further be thrown to traverse a distance between two points, such as in a game of throw and catch. The aerial toy has four equiangularly spaced blades which are joined at a common central body portion. Each blade terminates in a vane which is angled relative to the blade, with the tips of each vane attached to an outer circumferential ring.

1 Claim, 6 Drawing Figures

AERIAL TOY

FIELD OF THE INVENTION

This invention relates generally to flying toys, and particularly to an aerial toy which can function as a boomerang and returns to the thrower, or which can be thrown from one point to another, such as in a game of catch.

BACKGROUND OF THE INVENTION

Toy boomerangs are well known in the prior art. In general, such boomerangs employ two, four, or more blades joined at a common center. See, for example, U.S. Pat. Nos. 4,337,950, 3,955,817, 3,082,572, and 2,816,764. Such boomerangs or aerial toys when properly launched are designed to sail outwardly away from the point of launching a certain distance and then return to or near the launching site. The ability of such aerial toys to return to the sender is of course their primary attraction. The amusement value of these toys would be increased if the toy were also capable of being thrown from one point to another, such as in a game of catch between two individuals.

SUMMARY OF THE INVENTION

It is a general object of this invention to provide an improved aerial toy of the foregoing boomerang type.

A more specific object is to provide an aerial toy which can be launched to sail outwardly away from the point of launching and subsequently return to the point of launching, and which can further be thrown to traverse a distance between two points, such as in a game of throw and catch.

Yet another object of the invention is to provide such an aerial toy in a form which is safe and attractive, and designed so that an individual can acquire reasonable skill in throwing the toy with a small amount of practice.

Yet another object is to design an aerial toy which will optimally combine lift, drag, center of gravity, moment of inertia and overall weight to thereby yield an aerial toy which can return to the thrower or fly to another person, depending on the throw.

Yet another object is to provide an aerial toy which can be molded into an integral piece such that the toy is simply and economically manufactured, yet is of sufficiently rugged construction so as to withstand rough handling and usage.

These and other objects are accomplished in this invention in an improved aerial toy which is comprised of a central body portion from which radiate a plurality of equiangularly spaced elongate blades which are attached at their tips to an outer circumferential ring. In a presently preferred form, the aerial toy has four blades which extend outwardly and downwardly from the central body portion in a smooth curve and at an angle of between 4° and 8°, as measured from the plane of the upper face of the central body portion. The distal end of each blade is turned upwardly through an angle between 25° and 90°, as measured from the plane of each respective blade, to thereby form a vane. The tips of all of the vanes lie in a plane parallel with and slightly above the plane of the upper face of the central body portion and are connected to the outer circumferential ring. This ring has substantially flat upper and lower surfaces, with the tips of the vanes being attached to the ring along the inside edge thereof. Each blade has an upper and lower face, the upper face of each blade being substantially flat and the lower face being generally flat medially and then tapering laterally to an edge coincident with the upper face, thus providing a slight camber to each blade.

The aerial toy of this invention has two principal modes of use. It can be thrown in a manner such that it will go out from the thrower, pause, and then return very close to the launching site. The aerial toy can also be thrown such that it will follow a relatively straight line path between two separated points, such as between two individuals who can then engage in a game of throw and catch.

The toy's overally dynamics are such that when properly launched, the toy will experience a roll that will invert the toy, i.e., rotate its spin axis through 180°, in order to reach a more stable orientation. So inverted, the toy will either float back to its launch site, or continue away from the thrower, depending on how it was released.

The foregoing objectives, features, and advantages of the present invention will be more readily understood upon consideration of the following detailed description of the invention taken in conjunction with the accompanying drawings, in which:

DETAILED DESCRIPTION OF THE INVENTION

Figure 1:
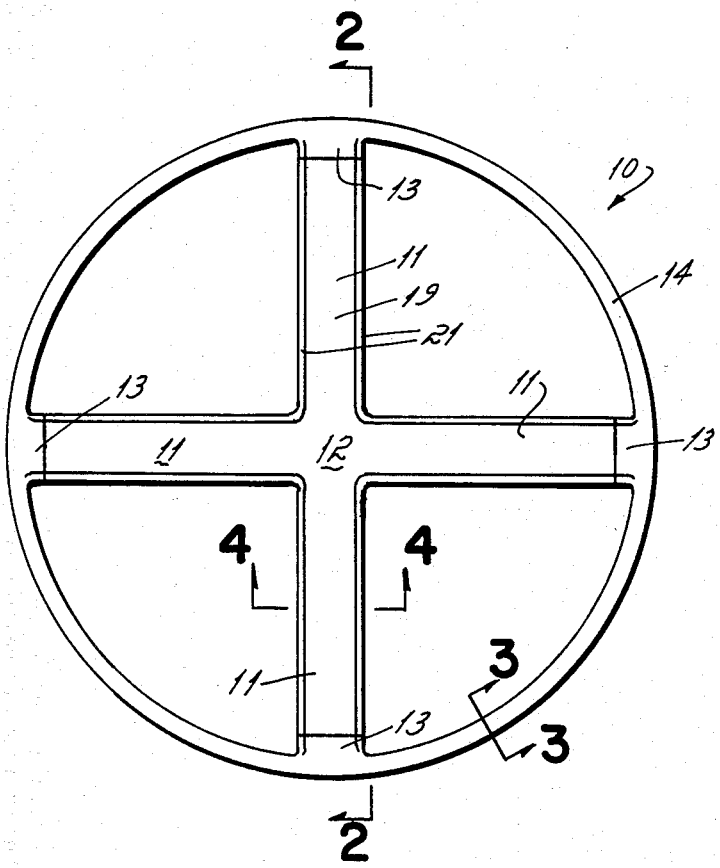
FIG. 1 is a plan view of the lower side of the aerial toy of this invention.

Referring to FIG. 1, the aerial toy of this invention is generally designated by the number 10. The principal components of the aerial toy 10 are four equiangularly spaced blades 11 which are joined at a common central body portion generally designated by the number 12. Each of the blades terminates in a toe or vane 13, with the tips of each vane 13 attached to an outer circumferential ring 14.

The aerial toy 10 and all of its components are preferably integrally formed out of an inexpensive rigid or semi-rigid light weight material, such as polypropylene plastic. Injection molding has been advantageously used to this end.

Figure 2:
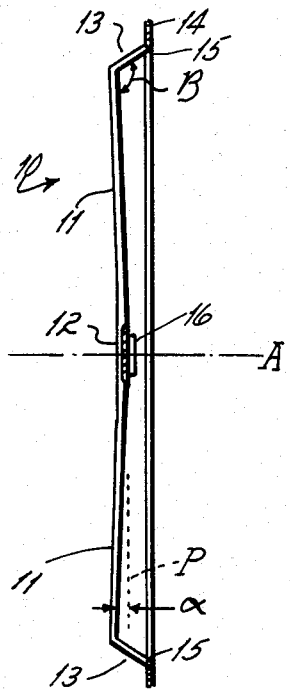
FIG. 2 is a cross-sectional view taken along line 2—2 of FIG. 1.
Figure 3:
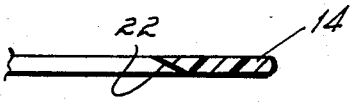
FIG. 3 is a cross-sectional view of the circumferential ring taken along line 3—3 of FIG. 1.
Figure 4:
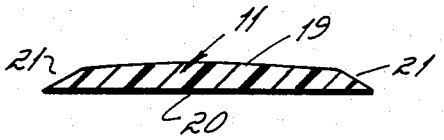
FIG. 4 is a cross-sectional view through one of the blades taken along line 4—4 of FIG. 1.
Figure 5:
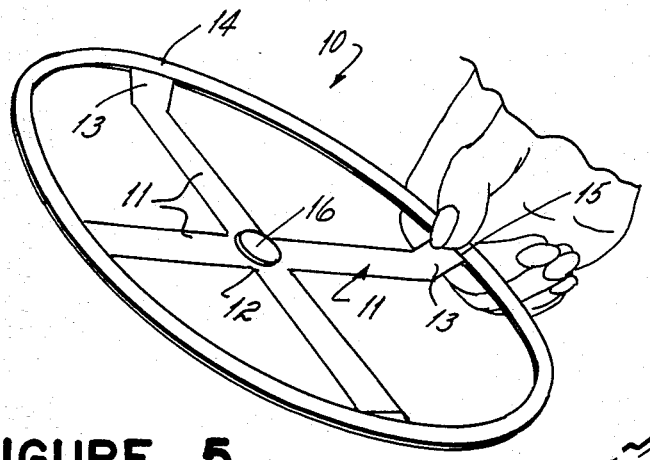
FIG. 5 is a perspective view of the upper side of the aerial toy showing how the toy is grasped for throwing.

For purposes of reference and description herein, it will be noted that the view of the aerial toy 10 shown in FIG. 1 shall be considered to be the bottom or lower portion of the aerial toy, whereas the view in FIG. 5 shows the top or upper portion of the aerial toy in perspective. Thus, FIG. 2 depicts the lower portion of the aerial toy at page left and the upper portion of the toy at page right. All designations and references to upper and lower, upward and downward, and the like shall hereafter accordingly be understood in light of these descriptive designations.

Referring now to FIG. 2, the blades 11 each extend outwardly from the central body portion 12, sloping downwardly from the central body portion in a gentle curve. The blades may have no slope, being coplanar, without seriously detracting from the performance of the toy; however, it has been discerned that a slight slope yields improved aerodynamic results in this model, owing to the fact that the center of gravity of the toy is thereby moved toward the plane of the ring 14. As will be made clearer hereafter, this tends to stabilize the toy once it has completed its roll maneuver. In a preferred form of this invention, the angle of this slope (alpha) is about 5°, as measured from the plane of the upper face of the central body portion, which plane here is shown in dotted line and designated by the letter P. Although an angle of 5° is presently preferred, an angle in the range of 4° to 8° can be advantageously employed.

The distal end of each blade 11 is turned upwardly to form the vanes 13. In the preferred form, the vanes are bent from the blades relatively sharply, and in an angle (beta) of between 25° and 90° as measured from the plane of each respective blade. As shown here, each vane makes an angle beta of 45° with its respective blade. The vanes herein make up about 12.5% of the total length of each blade, where the length of the blade is measured from the center or axis A of the central portion along the surface of the blade to the tip of the vane/blade 15.

In more detail, the central body portion 12 is thickened relative to the blades 11 to thereby increase the mass at the center of the aerial toy. The central portion may further include a lug 16 on the upper side for added weight. In this embodiment, the central body portion has a vertical thickness of about 4 mm (exclusive of the lug 16), with the blade 11 having a vertical thickness of about 2 mm. The ratio of the thicknesses between the central body portion and the blade is thus approximately 2:1. The blades 11 themselves are approximately 126 mm in length, with the vane portion accounting for approximately 16 mm of that length. Each of the identical blades has a substantially constant edge to edge or lateral width, here of 27 mm. The central body portion is on the order of 50 mm across. The entire weight of the toy made out of the aforementioned plastic is about 30 grams.

Although the blades 11 can both be made substantially flat on their upper and lower surfaces without seriously affecting the performance of the aerial toy, it has been found advantageous to slighly camber the blades. Accordingly, each blade is made slighly convex along its lower surface 19, with the upper surface 20 being substantially flat. This camber is provided through lateral tapers 21 along the entire length of each blade, including the vanes, which tapers end coincident with the respective side edge of the upper face of the blade.

The blade may be camberred more or less, even flat, as noted. However, it is presumed that the camber provided to the blades 11 provides the optimum airfoil characteristic for the flight of the aerial toy. In this regard, the slope (alpha) imposed on the blades is presumed to provide an optimum center of gravity to the toy, as noted, while also keeping translational drag at a minimum, futher enhancing the effect of the lift achieved as well as improving the overall flight characteristics of the toy.

The tips 15 of the vanes 13 are all coplanar, and are attached to the inside edge of the outer circumferential ring 14. The ring 14 serves a four-fold function in this invention. First, the ring 14 maintains the coplanar positioning of the tips of the vanes 13 during flight, while also adding a further element of rigidity to the aerial toy. Secondly, the ring 14 advantageously contributes to the mass moment of inertia of the toy, as well as its angular momentum component. Thirdly, the ring 14 provides a safety feature to the aerial toy by isolating the tips 15 of the vanes to thereby prevent injury to the thrower or receiver, and facilitates catching of the aerial toy. Lastly, the ring can be advantageously provided with a taper 22 which contributes to the rolling maneuver of the toy, as will be discussed more fully herein.

In the preferred design of the circumferential ring 14, the ring has a vertical thickness of about 1.5 mm and a lateral width of about 9 mm. The ring can be flat on both its upper and lower surfaces or, as here, can be advantageously provided with a slight camber. The camber herein is in the form of a slight taper or bevel 22 around the inside edge of the ring, with the taper extending from the upper surface downwardly to the bottom surface of the ring. An angle of between 10° and 30° measured from the plane of the ring 13, is considered to be desirable, with 15° considered to be optimum in this model. It will be noted that this taper 22 is opposite that of the blades. The shape and mass of the ring 14 is considered to be relatively important in the functioning of this device, due to the aforementioned contribution of the ring to the mass moment of inertia of the toy and its angular momentum component. The ring must accordingly not be too heavy or too light.

There are a number of ways in which this toy may be projected through the air, one mode causing the toy to return to the thrower, while another will cause the toy to fly, such as in a straightline path, to a point spaced from the launching site.

In order to throw the aerial toy in either mode, the toy is grasped at a juncture between the circumferential ring 14 and a vane 13 with the toy facing upwardly. An appropriate righthanded grip would be to grasp the toy between the right thumb and index finger such that the middle of the outermost phallange of the thumb rests in the bend between the blade 11 and the vane 13, with the joint of the thumb resting approximately at the attachment point between the circumferential ring 14 and vane tip 13 and the joints of the now curved index finger lying underneath the blade 11. The toy being tightly gripped in this manner, an energetic side-arm throw is employed which is coupled with a sharp flip or snap of the wrist at the point of release of the toy. The described method of gripping the aerial toy is shown in FIG. 5. It will be noted that the aerial toy faces generally upwardly when released, with the axis A of rotation extending generally normal to the ground rather than parallel thereto.

Figure 6:
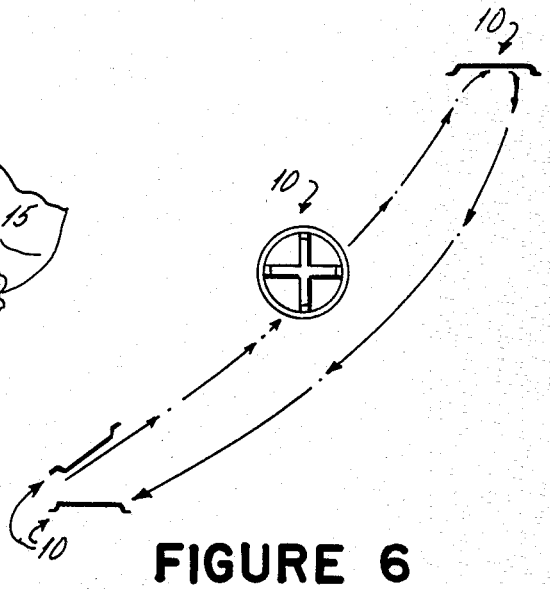
FIG. 6 is a schematic representation of the flight of the aerial toy when thrown so as to return to the launch site.

Employing the toy as a boomerang, that is, throwing it so as to have it return to the launch site, the toy is grasped in the foregoing manner and is thrown directly into the wind. The angle of launching relative to the ground will vary depending on the wind velocity. Best results are achieved when the toy is thrown into a gentle breeze of between 9 to 15 kms an hour, with a launching angle of around 30° to the horizontal. Correctly thrown, the toy will fly out from the launch site, begin to climb, and in the course of this climb, invert or roll through 180° so that the lower side is now facing upwardly (FIG. 6). The toy will continue to climb a short distance so inverted, whereupon it will then stall in the wind, and then float back generally along its outward path to the launch site.

The aerial toy may also be thrown so as to fly between two separated points, such as in a game of catch. To use the toy in this manner, it is again grasped and thrown in the foregoing manner. The angle of release with respect to the horizontal is, however, near to or substantially close to 0°; that is, the toy is released so that the ring 14 is substantially parallel with the ground. The toy will again travel outwardly from the thrower and execute its rolling maneuver. Once inverted, the toy will continue to fly away from the thrower, climbing a small distance at the end of its flight, whereupon it can be caught by another individual. If properly thrown, the toy can be made to climb and then hover in the vicinity of the catcher.

The aerial toy is considered to operate as follows. As the toy is released, its motion of two velocity vectors, one linear (V) and one angular (W). As each blade rotates through the oncoming air, a resultant force or torque is imparted to the toy as the oncoming air is deflected off the vane 13 of the blade 11 and the rearward portion of the ring taper 22 is exposed. This torque is about an axis generally transverse to the outward trajectory of the axial toy and in a generalized plane of the blades 11. Air deflected off the vanes 13 tends to tip the forward portion of the toy upwardly while the air deflected off the rearward ring taper 22 tends to tip the rearward portion of the toy downwardly, adding to the action of the vanes. While the aerial toy is experiencing this torque, it also experiences a "negative" lifting force created by the air foil blades as each rotate into the oncoming air. This causes the blades rotating into the oncoming air to move downwardly, thereby applying a torque to the aerial toy which is about an axis generally parallel to its trajectory.

Due to its spin, the reaction torque causes the flying toy to precess about an axis which is generally coincident with its direction of trajectory. Precession continues until the aerial toy is at or a little before the point of farthest outward travel, whereupon it is fully inverted. The climb as well as the rolling maneuver cause the aerial toy to lose forward velocity V and angular velocity W.

When thrown as a boomerang, the toy will eventually stall in the air, the relative velocities of the blades 11 being now substantially equal, whereupon the direction of travel reverses as the toy hovers on the wind. The primary forces acting on the aerial toy on its return flight are an upward lift from the wings and the downward pull of gravity, as well as angular momentum remaining serving to keep the blades rotating.

Thus, while the invention has been described in connection with a certain presently preferred embodiment, it will be immediately obvious to those skilled in the art that many modifications of structure, arrangement, proportions, elements, materials, and components can be used in the practice of the invention without departing from the principles of this invention.

What is claimed is:

1. An aerial toy comprising:

a central body portion, said central body portion having an upper and lower face, four equiangularly spaced, elongate blades radially extending from said central body portion, said blades extending outwardly and downwardly from said central body portion in a smooth curve and at an angle of about 5° measured from the plane of the upper face of the central body portion, the distal end of each blade being turned upwardly through an angle of about 25° to 90° measured from the plane of each respective blade, to thereby form a vane, the tips of all said vanes lying in a plane parallel with and slightly above the plane of the upper face of said central body portion, said vane comprising about 12° of the length of said blade, a thin outer circumferential ring attached to and coplanar with the tips of said vanes, said ring having generally parallel substantially flat upper and lower surfaces, said lower surface extending radially inwardly further than said upper surface such that said ring tapers from said upper surface to said lower surface along the radially inward portion of said ring, said ring having a generally squared-off leading edge, said tips being attached to the ring along the inside edge thereof, said central body portion and said blades each having a small thickness, the thickness of said central body portion being about twice the thickness of a blade, each blade having an upper and lower face, said upper face of each blade being substantially flat, and said lower face being generally flat medially and tapering laterally to an edge coincident with said upper face.

* * * * *